US010058724B2

(12) United States Patent
Duncan

(10) Patent No.: US 10,058,724 B2
(45) Date of Patent: Aug. 28, 2018

(54) APPARATUS FOR PLAYING A GAME BY EMITTING A MOVING BEAM OF RADIATION

(71) Applicant: Throwback Limited, Cardiff, South Glamorgan (GB)

(72) Inventor: Keegan Duncan, South Glamorgan (GB)

(73) Assignee: Throwback Limited (GB)

( * ) Notice: Subject to any disclaimer, the term of this patent is extended or adjusted under 35 U.S.C. 154(b) by 0 days.

(21) Appl. No.: 15/314,151

(22) PCT Filed: May 26, 2015

(86) PCT No.: PCT/GB2015/051531

§ 371 (c)(1),
(2) Date: Nov. 28, 2016

(87) PCT Pub. No.: WO2015/181536

PCT Pub. Date: Dec. 3, 2015

(65) Prior Publication Data

US 2017/0189731 A1 Jul. 6, 2017

(30) Foreign Application Priority Data

May 27, 2014 (GB) ..... 1409377.7
Jan. 6, 2015 (GB) ..... 1500134.0

(51) Int. Cl.

| | |
|---|---|
| ***A63F 9/24*** | (2006.01) |
| ***A63B 5/22*** | (2006.01) |
| ***A63B 71/06*** | (2006.01) |

(52) U.S. Cl.

CPC ..... *A63B 5/22* (2013.01); *A63B 71/0669* (2013.01); *A63B 2207/02* (2013.01); *A63B 2220/805* (2013.01); *A63B 2220/833* (2013.01); *A63B 2220/836* (2013.01); *A63B 2225/093* (2013.01)

(58) Field of Classification Search

CPC ..... A63B 21/4011; A63B 5/22
See application file for complete search history.

(56) References Cited

U.S. PATENT DOCUMENTS

| | | | |
|---|---|---|---|
| 3,898,747 | A | 8/1975 | Marshall |
| 4,545,583 | A | 10/1985 | Pearman et al. |
| 4,813,665 | A | 3/1989 | Carr |
| 5,888,179 | A | 3/1999 | Singhal |
| 5,931,766 | A | 8/1999 | Cooper |

FOREIGN PATENT DOCUMENTS

| | | | |
|---|---|---|---|
| CN | 2558405 | Y | 7/2003 |
| JP | S6085763 | A | 5/1985 |
| WO | 98/36400 | A1 | 8/1998 |
| WO | 2007/068908 | A1 | 6/2007 |
| WO | 2012/174847 | A2 | 12/2012 |

OTHER PUBLICATIONS

Combined Search and Examination Report dated Jul. 6, 2015, for British Application No. 1500134.0 (7 p.).
PCT/GB2015/051531 Search Report and Written Opinion dated Jul. 20, 2015 (9 p.).

*Primary Examiner* — Steve Rowland
(74) *Attorney, Agent, or Firm* — Conley Rose, P.C.

(57) ABSTRACT

The invention provides an apparatus for playing a game, the apparatus comprising; a moveable portion configured to emit a moving beam of radiation; a detector and a device arranged to be worn by a player, wherein the device is configured to send a signal to the detector in response to interaction with the beam.

20 Claims, 11 Drawing Sheets

APPARATUS FOR PLAYING A GAME BY EMITTING A MOVING BEAM OF RADIATION

CROSS-REFERENCE TO RELATED APPLICATIONS

This application is a 35 U.S.C. § 371 national stage application of PCT/GB2015/051531 filed May 26, 2015 and entitled "Apparatus for Playing a Game," which claims priority to British Application No. 1409377.7 filed May 27, 2014 and entitled "Apparatus for Playing a Game," and British Application No. 1500134.0 filed Jan. 6, 2015 and entitled "Apparatus for Playing a Game," each of which are hereby incorporated herein by reference in their entirety for all purposes.

STATEMENT REGARDING FEDERALLY SPONSORED RESEARCH OR DEVELOPMENT

Not applicable.

BACKGROUND

The present invention relates to an apparatus for playing a game. In embodiments, the present invention relates to a multiplayer game where players jump or skip to avoid a moving beam.

The media tends to reinforce the belief that a recent increase in the availability of computerized devices has resulted in youngsters leading a more sedentary and more solitary lifestyle. Parents are always interested in finding ways to encourage their children to interact with others and to exercise. Old-fashioned gaming devices such as the hula hoop, hoop and stick or skipping rope, however, do not hold such fascination when compared with the variety of modern computer or video games now available with their offerings of coloured images, sound effects and immersive storylines.

Lack of activity is also a problem among adults. In built up areas there is often not enough space to exercise effectively indoors. People attend gyms where modes of activity can be solitary and not particularly motivating.

Several modern games and devices attempt to combine physical activity with modern technology in order to make exercise more appealing. For example, WO-A-2012/174,847 describes a device comprising a platform with arrows and a screen. Sensors under the platform allow movement of the player to be detected and changes can be made on the screen in response to this movement.

WO-A-2007/068,908 describes a mechanism for rope-free skipping comprising a base plate and two hand held "spinners". The user moves the spinners as they would the handles of a skipping rope and jumps up and down on the base plate. The position of the "invisible" rope is calculated and compared with footfall on the base plate to determine whether or not the user has cleared the rope or not. It is also very common for skipping ropes to include automatic counters (e.g. CN-A-2,558,405) in order to enable a user to track their own activity during exercise.

Whilst these devices do encourage the user to be more active, they are generally only designed for use by one person at a time and do not really succeed in combining known exercise techniques with the interactive properties of computer and video games.

According to a first aspect of the present invention, there is provided an apparatus for playing a game, the apparatus comprising; a moveable portion configured to emit a moving beam of radiation, a detector and a device arranged to be worn by a player, wherein the device is configured to send a signal to the detector in response to interaction with the moving beam.

The invention provides a simple way to turn a common exercise technique (skipping or jumping) into a fun game that can be played by a number of players at once. Players must jump in order to avoid interrupting the moving beam and recording a hit. The interactive nature of the game is provided by the fact that the success of each player is constantly measured, recorded and then exhibited on a colourful display so that players are aware of the progress of the game. The difficulty level can also be adapted as the game progresses and, because of the compact nature of the apparatus, the game can easily be played indoors in a house or gym as well as outdoors.

Preferably, the apparatus further comprises at least one counter. Each player is allocated a number of "lives" at the start of each game. Whenever a player fails to clear the beam, which will result in some interaction between the device they are wearing and the beam, their counter increments by one and records the hit. Interaction in this sense refers to being hit by or being within a defined distance from the beam. The player then loses a life but is not out of the game until all his/her lives are used up. The number of lives allocated to each player at the start of the game can also be altered, using the counters, in order to adapt the average length of a game to suit different players. The number of allocated lives need not necessarily be the same for all players in a game, for example a "handicap" can be given to certain players if desired and these players will be allocated extra lives.

Preferably, the apparatus comprises a plurality of counters, each counter corresponding to a portion of the area swept out by the beam of radiation, wherein each counter is configured to increment by one if the detector detects a signal when the beam is located in the portion of the area corresponding to that counter. Each player is associated with a counter and the number of hits for each player during each game is recorded on their own counter. The apparatus can include a switch which switches between different counters as the beam rotates in order to ensure that a hit is recorded for the correct player.

In an embodiment, the device arranged to be worn by a player has a reflective outer layer. This way, when the device interacts with the beam of radiation (e.g. when the player fails to jump sufficiently high to clear the beam) light is reflected directly back to the point on the apparatus from which it was emitted. A detector can be located on or near to this point to detect the reflected light and send a signal to the relevant counter to cause it to increment by one. The device or devices worn by the player can thus be manufactured cheaply and will be extremely lightweight since no electronics or other components are required.

Preferably, the device arranged to be worn by a user is worn around the ankle. The device needs to be located near to the lowest part of a player's body to avoid their foot or leg interrupting the beam rather than the reflective device, in which case the apparatus would fail to register a legitimate hit. An ankle band is a convenient way to wear the device and Velcro® or a similar sticky material can be used for easy attachment or removal without any additional parts being necessary. The height of the ankle band is important. It must be long enough to ensure that a hit is registered but not so long as to inconvenience the user. Additional devices can be worn on the feet (attached to or in place of shoes for example) to ensure that every hit is registered, however these add additional time to preparations for play and more importantly will require extra parts which add to manufacturing costs and can easily be misplaced. Preferably, players will wear reflectors on both ankles. This prevents them from simply lifting one leg in order to clear the beam and allows them to jump side on to the beam and facing in either direction if desired.

Preferably, the moveable portion is configured to be moveable in the upwards and downwards direction. The height of the beam can be adjusted so that users are forced to jump to different heights in order to clear it. This adjustment can be made before the game begins and/or the height can change during the game according to pre-programmed parameters or the success of participants.

In an embodiment, the moveable portion is configured to slide along a horizontal rail. This way the apparatus can either be easily mounted on a wall or to a free-standing structure and can has no length restriction allowing for the possibility of a large number of players participating at once.

In an embodiment, the moveable portion is a rotatable portion. A rotating beam is an easy way to achieve a compact, free-standing configuration for the apparatus and allows players to stand in a circle facing one another which will tend to encourage interaction during the game.

Preferably, the detector is attached to the moveable portion adjacent to the emitting portion. If the device worn by the player is formed of a reflective material then when a beam is interrupted by the device the beam of radiation is reflected back in the direction from which it was emitted. A detector can be located near to the emitting portion to ensure that any reflection of the beam will be picked up.

Preferably, the apparatus further comprises a display section. It is important that players are aware during a game of how many hits they have registered compared to their competitors. Every hit recorded by each player should be reflected in changes on the display. The display portion can be orientated to face the players and can extend through 360 degrees if players are standing in a circle so that each player is directly opposite at least a portion of the display screen. The portion facing each player is configured primarily to show that particular player how many hits they themselves have registered. The display also allows for the inclusion of lights, colours and perhaps sounds which all add to the excitement of the game. Preferably, when one of the plurality of counters increments by one the display section is configured to change to reflect this increment.

Preferably, the apparatus further comprises a stationary base section. The base section acts to support the structure in its upright position and will generally be wider than the rest of the apparatus in order to achieve this function. Additional weight can be added to improve stability.

Preferably, the beam of radiation has a vertical beam angle of between 10 and 60 degrees. It is important to ensure that if a player does not attempt to clear the beam and remains standing the apparatus will register a hit. This can be achieved by using a beam with a fairly large vertical beam angle (spreading angle of the beam in the vertical direction). This way the beam covers a range of heights from at or near ground level to the required jumping height.

In an embodiment, the moveable portion is configured to move upwards and downwards using a rack and pinion mechanism. The rack and pinion mechanism is simple and requires fairly few parts, namely a motor, toothed gear wheel and toothed pole.

In an embodiment, the moveable portion is configured to move upwards and downwards using one or more electrically powered rotors. These are located on the moveable portion. The moveable portion thus appears to "fly" up and down. Rotors mounted on the moveable portion itself provide a compact mechanism.

In an embodiment, the moveable portion is configured to move upwards and downwards using a lifting jack mechanism, which provides a stable structure with few small parts that may be more at risk of breaking.

In an embodiment, the moveable portion is configured to move upwards and downwards using a belt and gear mechanism. Similar to the rack and pinion, the belt and gear system is simple and compact. The mechanism can be hidden inside a C-shaped pole having a slot through which a block (attached to the moving belt) can protrude in order to carry the moveable portion up and down a pole. A motor located in the base section can turn a gear wheel also located in the base section to cause the belt to travel.

In an embodiment, the rotatable portion is configured to rotate and to move upwards and downwards using a tilting wheel and motor mechanism. A single rubber wheel is mounted on the rotatable portion or on a shaft to which the rotatable portion is attached. As the rubber wheel turns the rotatable portion rotates about a central pole. To cause the rotatable portion to rise and fall the rubber wheel can be tilted slightly so that it "climbs" the pole. The systems that control both the spinning motion and the rising/falling motion of the rotatable portion can thus be integrated neatly into one simple mechanism.

In an embodiment, the rotatable portion is configured to rotate using a toothed belt and motor. In an embodiment, the rotatable portion is configured to rotate using gears and a motor. Both mechanisms are compact and require few parts which can be hidden within a simple plastic casing for protection and aesthetic purposes if desired.

In an embodiment, the rotatable portion is configured to rotate using a motor, disc and wheel. In an embodiment, the rotatable portion is configured to rotate using a rubber wheel coupled to a fixed section. The rubber wheel eliminates the need for teeth which may break or slip so that they no longer fit or grip as they should. A fixed and rotating section move up and down a central pole together so that it is possible to mount components that will not rotate but will move up and down with the rotating portion. In an embodiment the display portion is mounted on this non-rotating disk. Whilst playing, users will need to keep the section from which the beam is emitted in their sights so will be looking at the rotating portion for the majority of the time. A non-rotating display could mimic or replace the static display or could show the user the position of the beam at times when it is located on the opposite side of the apparatus and may not be directly visible.

In an embodiment, the rotatable portion is arranged to rotate through a full 360 degrees and/or can rotate in either direction.

Embodiments of the present invention will now be described in detail with reference to the accompanying drawings, in which.

Figure 1:
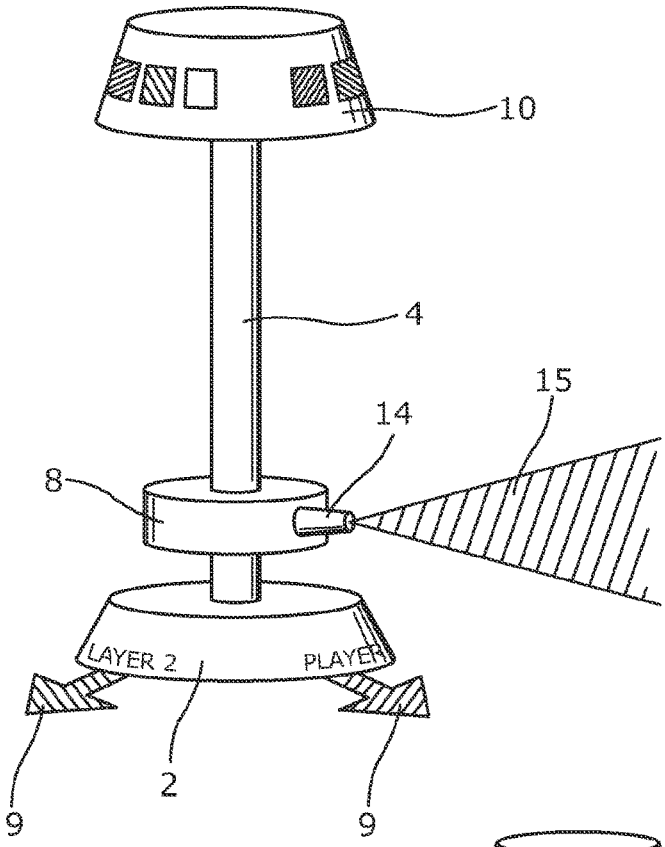
FIG. 1 shows an apparatus for playing a game according to an embodiment of the present invention.

FIG. 1 shows an apparatus for playing a game according to an embodiment of the present invention. The apparatus is mounted on a stationary base section 2 from which a pole 4 extends vertically. A rotatable portion 8 is configured to be moveable up and down the pole 4. As will be explained below, the rotatable portion 8 is a non-limiting example of a moveable portion configured to emit a moving beam of radiation.

A stationary display portion 10 is located at the top of the pole at a convenient height so as to be visible to all players. This display portion 8 can also be moveable up and down the pole 4 and can be clamped at a height to suit the age/size of different players. In embodiments, described later, the display section moves up and down the pole adjacent to the moveable portion. The base, pole, rotatable portion and display portion can be made of any material that is cheap to produce, robust and lightweight. Plastics are particularly suitable. The base section 2 may be wholly or partially formed of a heavier material or may contain a weight in order to anchor the structure.

Figure 2:
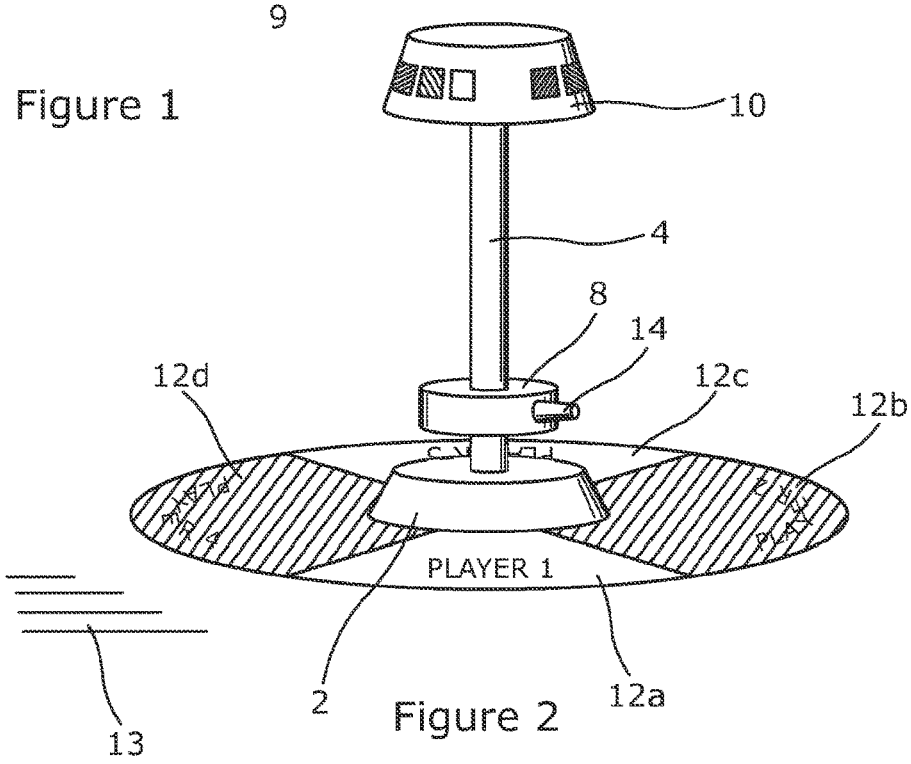
FIG. 2 shows an apparatus for playing a game comprising a floor mat for indicating where players should stand.

Arrows or pointers 9 extend from the base section. These pointers indicate to the players where they should stand during the game. Players stand facing and slightly back from the central apparatus so that one of the four pointers is directed towards them. In place of a pointer a floor mat can be used (as shown in FIG. 2) to indicate segments of the playing surface 13 on which each player should stand. In FIG. 2 the territories 12*a-d* of each of the four players are coloured differently or in an alternating fashion and/or are marked with text. The floor mat can be rubberised in order to prevent players from slipping or the mat from slipping on the playing surface. In some cases the game may be played in the dark or in low light and territories can be indicated by illuminating sections in different colours or by illuminating divisions between the sections.

Figure 3:
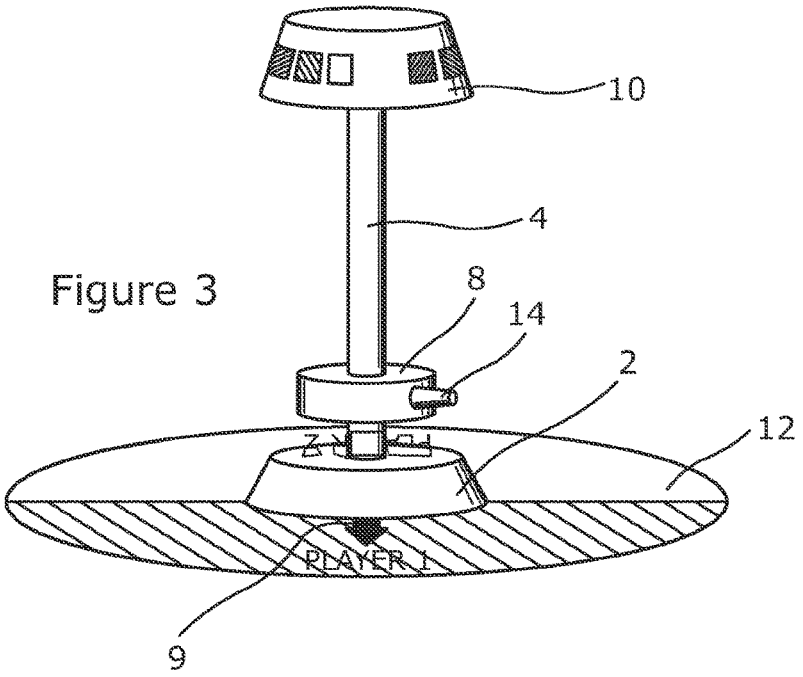
FIG. 3 shows a two player version of the apparatus of FIG. 2.

In the embodiment shown in FIGS. 1 and 2 the game is designed for four players, however in other embodiments more or fewer players can be accommodated in which case the number of pointers will correspond to the number of players for which the game is intended. Pointers may be reversibly extendible from the base portion (either fully or partly, for example pointers can be able to be pushed in up to the base of the triangular portion) to facilitate transport and storage. When the game is not being used pointers can be stored wholly or partly within the base to achieve a more compact structure and to protect the more delicate parts of the apparatus. Alternatively pointers can be foldable towards the base portion or removable. A two player version is shown in FIG. 3 wherein both a mat and pointers are included. There are two pointer arrows 9 and the mat 12 is divided into two differently coloured sections (halves). If one or two players wish to play on an apparatus designed for more than two then the additional player territories can be ignored. Where a territory is not being used, the display for the missing player can be switched off. The display section can comprise buttons to allow the display portions for each player to be switched on and off separately. Alternatively, at the start of play, the apparatus can be programmed to perform an initialisation step. This may comprise one or several rotations of the moveable portion with the beam switched on and players standing in position ready to play. The apparatus will then detect the players and will be able to automatically disable displays for territories where no player is detected.

Referring again to FIG. 1, moveable portion 8 (rotatable in this example) is also moveable up and down the pole 4. Mechanisms by which this raising and lowering can be achieved as well as mechanisms for rotating the rotatable portion will be discussed later. The rotatable portion 8 includes a protruding part 14 from which a beam of radiation is emitted during play. The radiation may be in the visible region of the EM spectrum so that the protruding part simply contains a coloured or white bulb which, when switched on, emits a beam of light that rotates along with the spinning section.

Figure 4A:
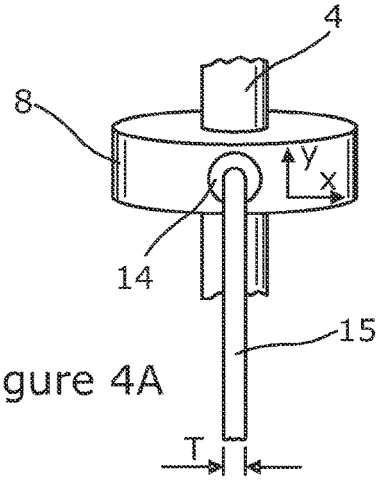
FIG. 4A shows a side-on view of a rotating portion, protruding section and beam with the beam directed at the viewer.
Figure 4B:
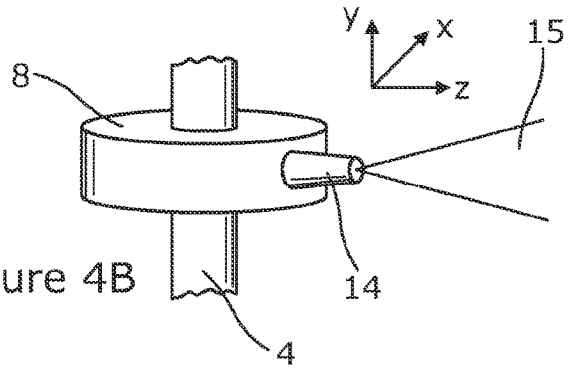
FIG. 4B shows a side-on view of a rotating portion, protruding section and beam with the beam rotated to be directed slightly away from the viewer.
Figure 5:
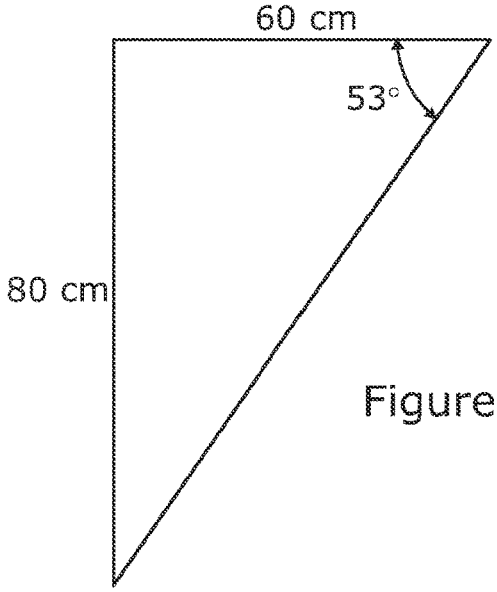
FIG. 5 illustrates the calculation of required vertical spreading angle with a jumping height of 80 cm for a player standing 60 cm from the centre of the apparatus.

FIGS. 4A and 4B show the configuration of the beam 15, in an embodiment, when facing the viewer and when rotated to face slightly away from the viewer. As shown in FIG. 4A, the beam has a small thickness T in the horizontal direction X but is spread in the vertical direction Y so that it extends through an angle of between 10 and 60 degrees, preferably at the upper end of this set of values. The spreading of the beam is shown in FIG. 4B. In an example using representative values if a player stands 60 cm from the centre of the apparatus during a game where the height that a player can be expected to jump can be anywhere up to a maximum of 80 cm, the required vertical beam angle in order to ensure a hit all the way down to the floor for any height of beam would be 53 degrees (see FIG. 5). Of course this particular beam configuration is not essential and the beam is not required to reach all the way to the floor. If the player wears a reflective device on the ankle and the maximum jump height is lower then the required beam spread is not so high. The beam angle in both the vertical and horizontal directions as well as the vertical orientation of the beam can be controlled by the size and shape of a window at the end of the protruding section through which light from the bulb must travel. For example, a narrow slit-like window extending vertically could produce the desired beam dimensions. Alternatively, a narrow optical or laser beam can be spread in the vertical direction using a lens or a similar mechanism.

Figure 4C:
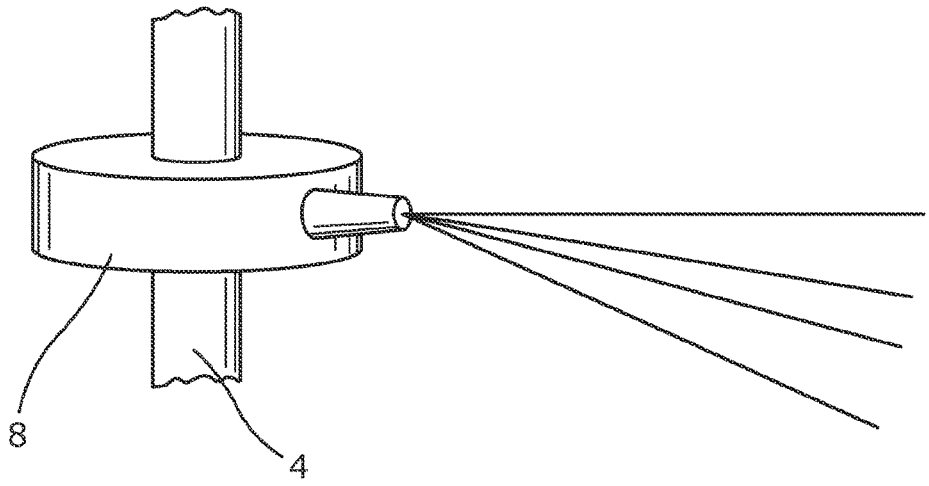
FIG. 4C shows an apparatus having two beams.

In embodiments, a number of beams may be used to more fully cover the area between the jump height (the height of the moveable portion) and the floor (this will also reduce the individual beam spreads required to ensure a hit to a player who has failed to clear the jump height). FIG. 4C shows an example of an apparatus for which the protruding portion carries two beams. These can be angled, as shown, and may have more or less of a vertical (and/or horizontal) spread. The precise configuration of the beam spreads can be varied as desired to ensure maximum vertical spread to ensure that there is no free or uncovered vertical space for a user to be and within which they can avoid detection. It might be preferred to use two or more narrow pencil beams or to use two or more vertically spread beams or some combination of pencil or spread beams. In a preferred example two or more vertically spread beams are used wherein there is vertical (and/or horizontal) overlap between the beams to ensure a continuous vertical capture zone. Overall then, in embodiments, a plurality of beams is used to ensure a desired spread pattern to detect users playing the game. The plurality of beams can be provided by individual dedicated beam sources or by appropriate modulation of a single beam source.

Figure 4D:
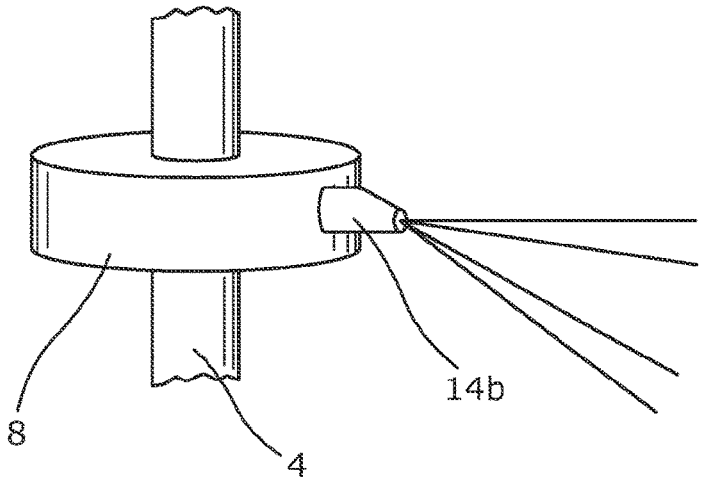
FIG. 4D shows a protruding section comprising a shaped nozzle.

A shaped nozzle can also be applied to the end of the protruding portion in order to direct the beam/beams in the desired direction. An example of such a shaped nozzle 14*b* is shown in FIG. 4D. Again two beams are shown, the upper of which is directed towards the floor by the sloped wall of the nozzle. Different nozzle shapes can be applied to change the shape of the beam and these can be removable and replaceable on the protruding portion to provide the user with some choice in terms of beam configuration. The beam source(s) can also be replaceable to provide the user with a choice of beam type, strength or colour.

Figure 4E:
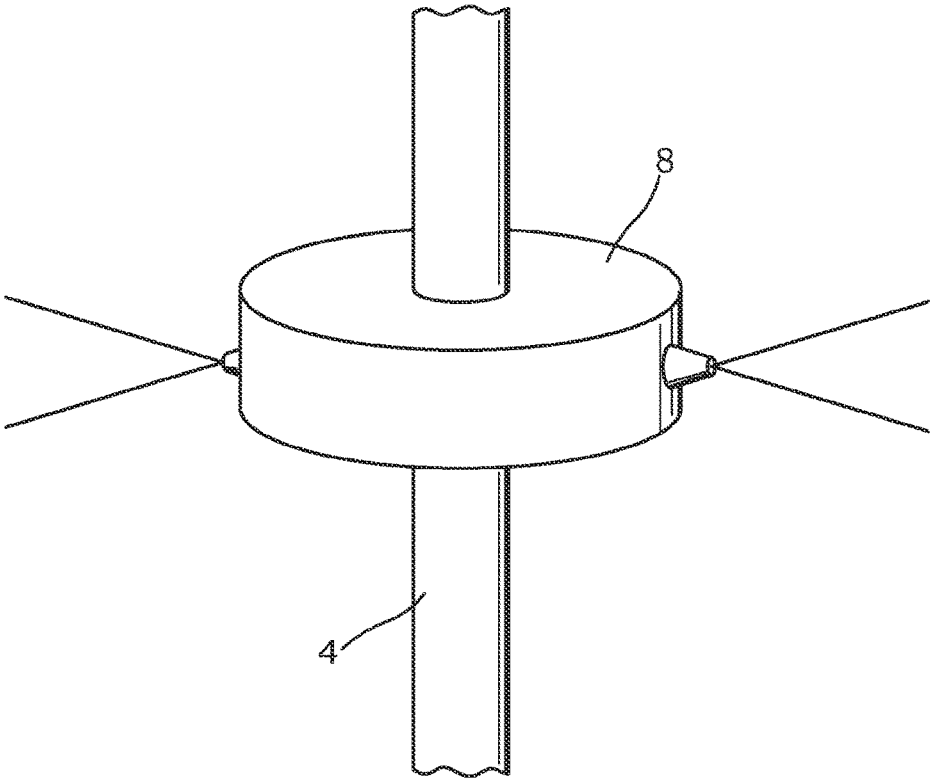
FIG. 4E shows a rotating portion with two nozzles on opposite sides thereof.

In another example two (or more) beam sources could be provided at different radial positions on the rotating portion, e.g. on diametrically opposite side of the rotating portion (e.g. 12 'o clock and 6 'o clock positions). This will have the effect of (at least) doubling the number of jumps required by a player per cycle of rotation. The rotating portion could then be rotated at a slower speed whilst still requiring the same jump frequency from a player, or it could increase the required the jump frequency without requiring higher rotational speeds for the rotating portion. Overall then, in embodiments, a plurality of beam sources are provided at different radial positions on the rotating portion. This is shown schematically in FIG. 4E. Each of the individual beam sources could be as described anywhere else herein, e.g. including one or more beams, each optionally being spread vertically and/or horizontally.

Generally, if the game is played during the daytime, particularly on a bright day and outside, it will be difficult to see the beam itself. The protruding part enables the players to keep track of the position of the beam if the beam itself is not visible. In some embodiments the protruding part may be configured to spray water, oil, a coloured liquid, or another discernable substance which will make viewing the position of the beam easier. It will also add a further element since a failure to clear the beam will now result in a player getting wet or sprayed with a coloured substance. It is important to ensure that the substance does not partially reflect or attenuate the beam of light which may affect the mechanism by which a hit is recorded.

Figure 6:
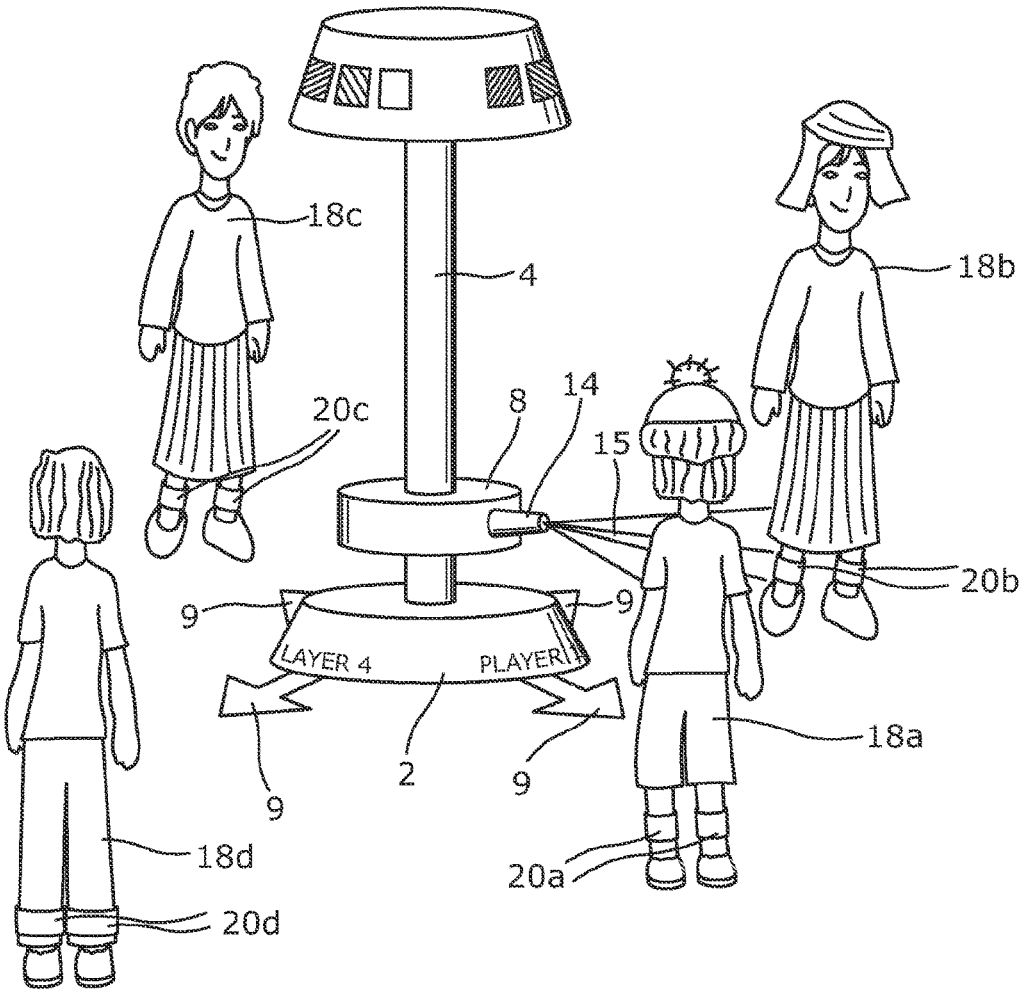
FIG. 6 shows an apparatus (not to scale) for playing a game during a four player game.

FIG. 6 shows the game during play. Each of the four players 18*a-d* wears a set of reflective ankle bands 20*a-d* and the players stand at roughly 90 degrees to one another, spaced around the central pole 4 as indicated by the arrows 9 attached to the base section 2. The apparatus is switched on either via a button on the base or remotely using a controller. Indeed any of the controls provided on the apparatus can be activated either directly by physical interaction by a user or with the use of a remote control device.

At this point the rotatable portion 8 begins to rotate, the light beam 15 is turned on and the apparatus may perform its initialisation step with the players standing still in order to disable displays which are not being used and provide players with their full quota of "lives". Following this the rotatable portion begins to move up and down the central pole 4. When the protruding section 14 points towards a player (the beam is directed at player 18*b* in the figure), they must jump to avoid interrupting the light beam. If they do not jump or do not jump sufficiently high then the light beam will strike the ankle band. The rotatable portion moves through a full 360 degrees and can rotate in either direction. In some embodiments the rotation direction may change throughout the game for example it may change randomly, in response to the passing of a fixed amount of time or in the event of the beam hitting a player. Consequently, when the direction of the beam is not changing and four players are participating (players 1-4) the beam will sweep through the territories of player 1, player 2, player 3, and player 4 in turn before returning to its initial position and sweeping a second time through the territory of player 1, player 2 and so on.

The material of the ankle band is reflective so that the light beam is reflected and hits the protruding section (or the vicinity) to which a detector is mounted. The detector detects the reflected beam. In FIG. 6 player 20*b* has failed to jump and one of the ankle bands is reflecting the light back to the detector in the protruding section (dotted beam). In embodiments the ankle bands can contain detectors and transmitters so that when a light beam is detected, radiation of the same or a different wavelength is emitted towards the detector in contrast to direct reflection. The reflecting bands need not necessarily be attached to the ankle and can be in the form of a pad or a vertically orientated length of material covering a length of each players leg rather than a band, however they must be located fairly near to the ground so as to be able to interrupt the beam below a certain level and a band ensures reflection whether the player is facing in the forwards direction or not.

Figure 7A:
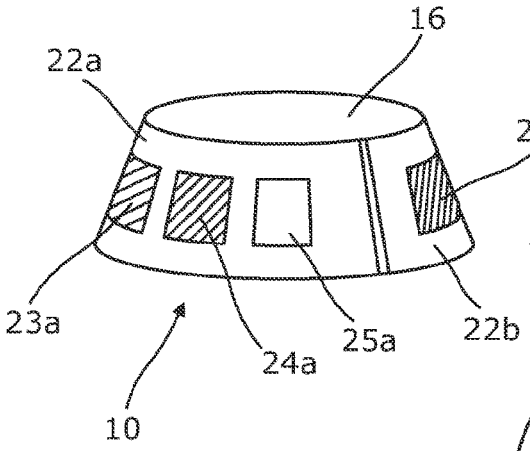
FIG. 7A shows a side-on view of a display section.
Figure 7B:
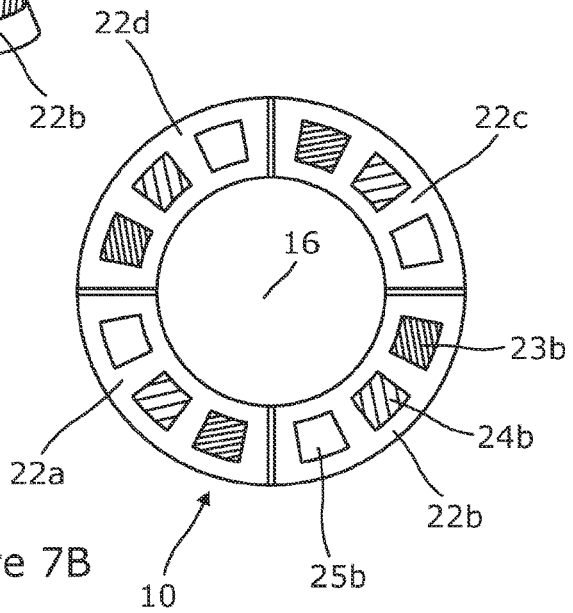
FIG. 7B shows a plan view of a display section.

FIG. 7 provides more detail of the display portion 10 in an embodiment. FIG. 7*a* is a side view and 7*b* a plan view. The display portion is generally frustoconical with the upper face 16 smaller than the lower face 17. The sides of the display portion thus appear as uniform in shape through the full 360 degrees. The frustoconical shape also means that the side face slopes upwards slightly making it more easily visible to the players but this is not mandatory and depending on the height of the apparatus and of the players a flat display may be more effective. As mentioned above the height of the display section can be made to be adjustable to suit different players. Each of the four sections 22*a-d* each forming a part (quarter) of the side face of the display portion will present information relating to one of the four players. In the embodiment shown each section comprises a set of three lights, one red 23, one amber 24 and one green 25 and faces the relevant player at all times in order to be easily visible to them.

The apparatus also contains four counters, one associated with each of the four players. Each of the arrows extends from the centre of a quarter section of the circle swept out by the rotating beam. When the light beam is directed towards a player in the direction of an arrow and reflected light from the player's ankle band is detected, the counter associated with that player will increment by one. In response to this, the display associated with the same player will change to indicate loss of a life. At the start of each game the green light 25 is lit up on all four displays. When a player fails to jump and avoid the rotating beam for the first time during the game, their green light flashes. After a second hit their green light turns off and their amber light 24 turns on. After a third hit their amber light flashes. A fourth hit leads to their amber light turning off and their red light 23 turning on. A fifth hit causes their red light to flash and a sixth hit means all three lights on the players display turn off and the player is out of the game. The game can either end at this point or can continue until only one player still has one or some of the lights on their display turned on at which point they are crowned the winner. In embodiments a hit may simply be indicated by one of several lights on a player's display switching off. For example, the display may comprise six lights for each player. All six are switched on at the start of a game and they are switched off one by one as a player is hit. When all six of the lights on a player's display have switched off the player is out of the game.

In place of coloured blocks or a set of lights, the display for each player can present a number that either decreases by one each time that player is hit to indicate the number of lives remaining or increases by one to indicate the number of registered hits for that game. In embodiments, a small portion of the display for each player (for example a small window in the top left or right corner) indicates the status of the other players. Sound and vibration can be included to remind a player when he/she has one life remaining or to congratulate a player on winning. In principle sound effects can be included for any aspect of the game, for example a tyre skidding noise when the rotatable portion changes its rotation direction or some suitable indication when any player leaves the game or a victor is crowned. The display portion can comprise a volume control that allows users to control the noise level of the sound effects or to switch them off altogether. Speakers and circuitry to control the sound will generally be housed within the base or rotatable portion and several speakers can be included facing in different directions so that sounds are equally audible to all the players.

To ensure that the correct counter increments when a player is hit, some type of circuit with a switching mechanism can be included. As the rotatable portion rotates, each of the four counters can be connected up in turn to link the particular counter connected at any time with the position of the beam at that time. Electronics controlling the lights on the displays, drive mechanism for the moving parts, light beam, detector and counters among others can be housed in the base section away from moving parts which will preferably be as light as possible to allow them to be driven with minimal input power.

A central processor controls the speed with which moving sections travel up and down and the rotatable portion rotates. The apparatus can be configured so that the speed of rotation and the height of the light beam change over time. Preferably, as a game proceeds the beam will move higher and spin faster to increase the level of difficulty and build excitement. The direction of the beam can also change throughout the game to make avoiding it even more challenging. The protruding section can be configured to be able to angle the beam in any direction and can be controlled to move throughout the game in order to change this angle. Speed of change in direction of the beam can also be controlled.

In embodiments, the apparatus can be configured to provide several different levels of difficulty for selection prior to starting a game and a mechanism to allow users to select "levels" of difficulty can be included on the display section. It is also possible to include timed levels where the difficulty increases after one or more players have "survived" for a pre-determined length of time. The difficulty can then continue to increase at intervals until all players have been knocked out. The beam should be configured to reach a maximum height at which it is difficult (but not impossible) to clear. Preferably the beam or spread angle of the light beam will ensure that, even with the beam at maximum height, if a player remains standing on the floor and does not attempt to jump, a portion of the light beam will still be reflected by the ankle band of the player and consequently the hit will be detected.

The mechanism for moving the rotatable and display portions up and down the central pole and for rotating the rotatable portion on the pole will now be described in greater detail.

Figure 9:
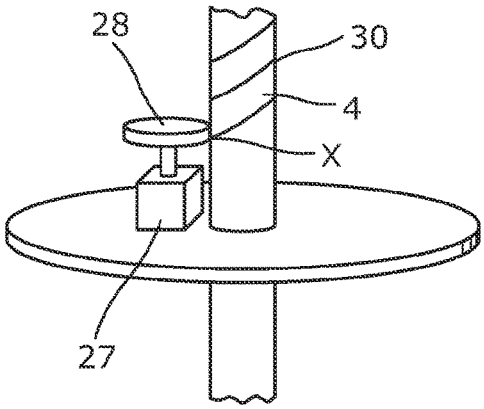
FIG. 9 shows a mechanism for causing the rotating portion to rotate and to move up and down.

FIG. 9 shows a mechanism by which the rotation and vertical motion of the rotatable portion can be achieved. The pole 4 extends vertically upwards away from the base and through a small hole in disk 26. There is sufficient friction (for example in a belt and gear mechanism attached to a non-rotating part of the moveable portion or simply between the disk and pole itself) for the disk to remain at a certain height with the motor switched off (or it can be held on the pole in another way and be disengaged when the disk moves up or down). Disk 26 is coupled to the rotatable portion of the game playing apparatus. A motor 27 and a rubber wheel 28 are attached to the disk and the rubber wheel contacts the central pole 4 at a point X along its edge as shown in the figure. As the motor 27 and rubber wheel 28 turn, the disk 26 and pole 4 begin to rotate relative to one another. This is helped by the rubber material of the wheel 28 which prevents slipping relative to the pole. In order to raise and lower disk 26 the rubber wheel can be tilted causing it to "climb" the pole along dotted path 30 lifting the disk with it. To cause the disk to travel down the pole the wheel can be tilted in the opposite sense. The edges of the rubber wheel 28 (e.g. where the upper and lower circular surfaces meet the side face of the wheel) can be rounded or tapered in order to ensure that sufficient frictional engagement is provided between the pole and wheel irrespective of angle of attack. This way the wheel will grip the pole more effectively when tilted.

In place of a rubber wheel, the central pole can include splines or ridges running vertically from base to top. The wheel 28 will then have teeth all the way around its outer rim designed to fit into the channels formed by the ridges and prevent the wheel from slipping relative to the pole as it turns. The teeth can be flexible or carefully shaped in order to ensure that teeth and channels engage even when the wheel is tilted away from the horizontal (for example channels can be wider than the teeth to provide some leeway in the relative position of the teeth and channels).

Figure 10:
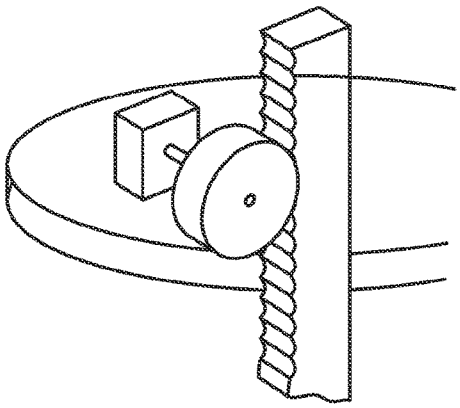
FIG. 10 shows a mechanism for causing the moveable portion to move up and down.
Figure 11:
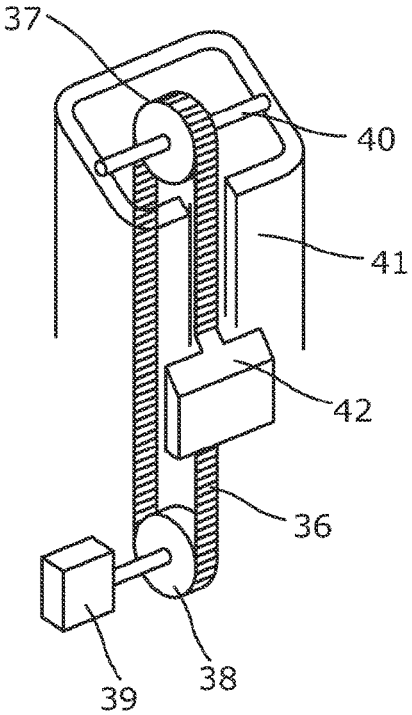
FIG. 11 shows an alternative mechanism for causing the moveable portion to move up and down.

FIG. 10 illustrates another possible mechanism for controlling the upwards and downwards motion of the rotatable portion. Here the pole 4 comprises teeth 31 along its length so that it can act as a linear gear or rack in a rack and pinion type mechanism. The circular gear or pinion 32 is attached to a motor 33 and is coupled to the rotatable portion via structure 34. As the motor 33 turns, the pinion 32 turns at the same speed and is forced up the rack by the interlocking of teeth 31 and 35. The direction of rotation of the motor can be reversed in order to move the rotatable portion back down the pole. The moving sections can also be made to travel up and down the pole via a belt as shown in FIG. 11. The belt 36 couples two gear wheels 37 and 38, one attached to a motor 39 in the base and the other to an axle 40 which is in turn supported at both ends to a C-shaped column 41 (dotted). The motor forces the belt to travel (in the manner of a conveyor belt) which causes the second gear wheel 37 to rotate. The belt is coupled to the rotatable portion via structure 42 and so, as it is pulled over the two gears, the spinning section moves upwards or downwards depending on the direction of the motor's rotation.

Figure 12:
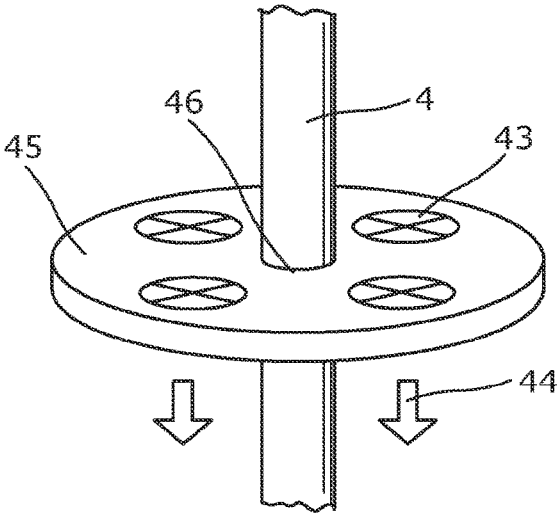
FIG. 12 shows another alternative mechanism for causing the moveable portion to move up and down.

In an embodiment the moving section is lifted by means of several electrically powered rotors. An example is shown in FIG. 12 in which 4 rotors 43 form part of either the rotatable portion or a structure coupled to the rotatable portion. When the blades rotate, air is sucked downwards in the direction of arrow 44 through the disc 45 which is forced upwards (action=reaction). The disc is not attached to the pole but the diameter of hole 46 in the centre of the disc and the pole are similar so that there is not too much give and the disc cannot tilt substantially or move horizontally. The hole is large enough, however, to allow the disc to slide up and down the pole with ease. Materials with low friction may line the inner surfaces of the hole and the pole in order to facilitate movement of the disc. In order to cause the disc to move downwards on the pole, the rotors are switched off or slowed and the disc drops back towards the ground under its own weight.

Figure 13:
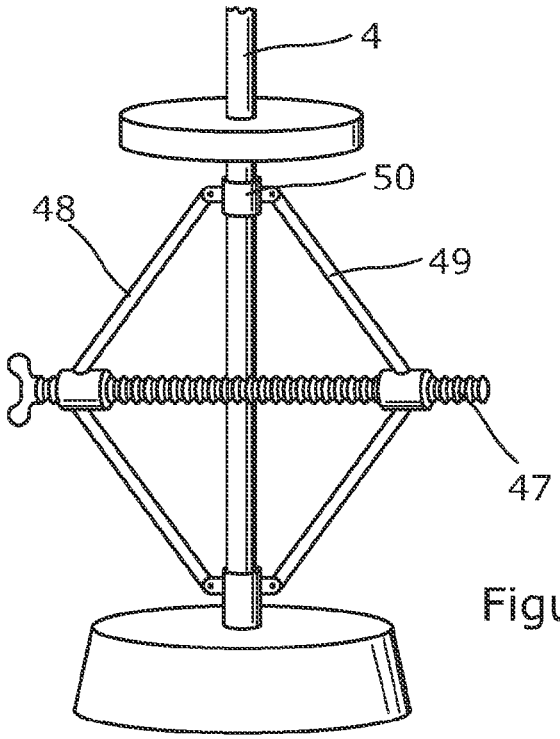
FIG. 13 shows yet another alternative mechanism for causing the moveable portion to move up and down.

A lifting jack can also be employed as shown in FIG. 13 to raise and lower the rotatable portion. Screw 47 is rotated by the action of a motor which forces hinged arms 48 and 49 closer together and causes them to extend vertically. When not fully extended, the arms form a diamond in side view (as in the figure) the vertex of which is coupled to the moveable portion. The vertex also comprises a sleeve 50 that fits around pole 4 and is able to slide easily over it. As the screw 47 rotates the vertex of the diamond formed by the arms moves upwards, along with the sleeve and the rotatable portion. The motor can be reversed to cause the screw rotated in an opposite direction which will lower the rotatable portion when required. The screw can be caused to rotate by the action of a motor.

Figure 14:
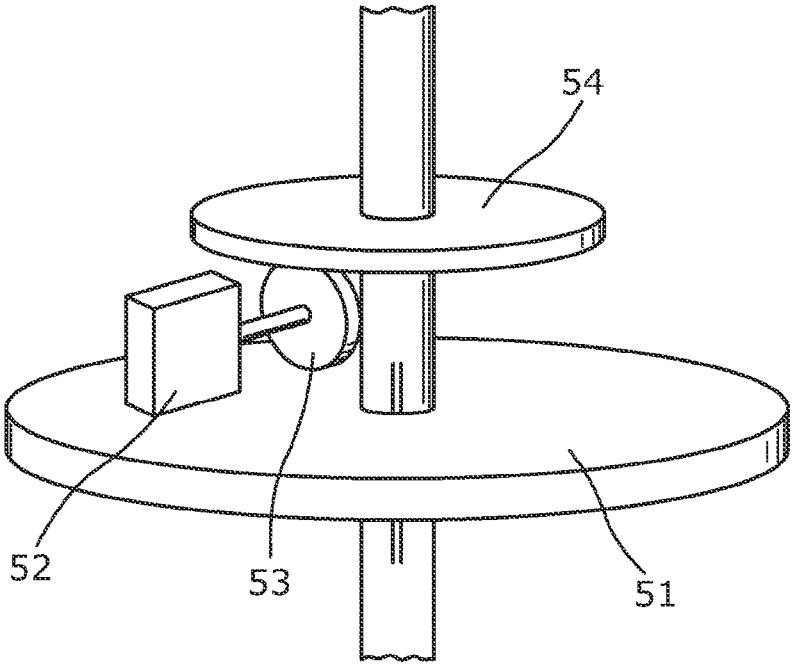
FIG. 14 shows a mechanism for causing the rotating portion to rotate.

In the embodiment shown in FIG. 14, a static portion or disk 51 is coupled to one of the raising and lowering mechanisms described above. This portion is prevented from rotating relative to the central pole (either by use of a keyway or by some other mechanism). This disk 51 is fixed to a motor 52 as shown in the figure which turns wheel 53 as it rotates. The wheel 53 does not contact lower disc 51 but does contact an upper disk 54. Friction between wheel 53 and upper disk 54 causes the upper disk to rotate at right angles to the wheel. Preferably the wheel is formed of rubber or a similar material to prevent slipping of the wheel and upper disk relative to one another. The upper disk 54 is coupled to the rotatable portion so that the speed and direction of rotation of the motor and the rubber wheel control how quickly the rotatable portion rotates and whether this rotation is clockwise or anti-clockwise. This embodiment provides for a portion that travels up and down on the central pole but does not rotate. The display portion can be located on this portion rather than elsewhere or alternative additional displays can be mounted here.

Figure 15:
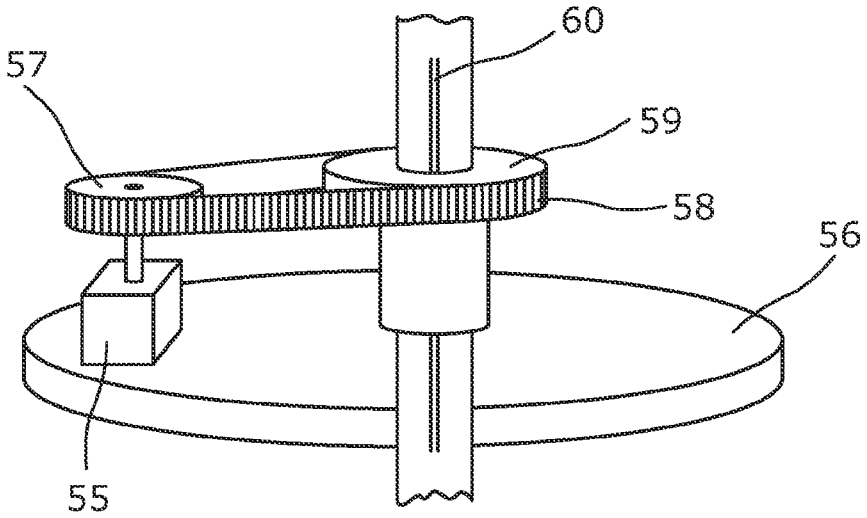
FIG. 15 shows an alternative mechanism for causing the rotating portion to rotate.

FIG. 15 illustrates a mechanism by which the rotatable portion can be made to rotate using a simple toothed belt and gear wheel. A motor 55, fixed to the rotatable portion via structure 56, causes the gear wheel 57 to turn a horizontally orientated belt 58 attached to another gear wheel 59 slideably mounted to the central pole. The gears are forced to rotate relative to one another and, since the second gear 59 is fixed on the pole by keyway 60, the disc 56 is forced to rotate. A similar mechanism (shown in FIG. 15) can be used where two interlocking gears 61 and 62 are used rather than coupling the gears using a belt.

Figure 8:
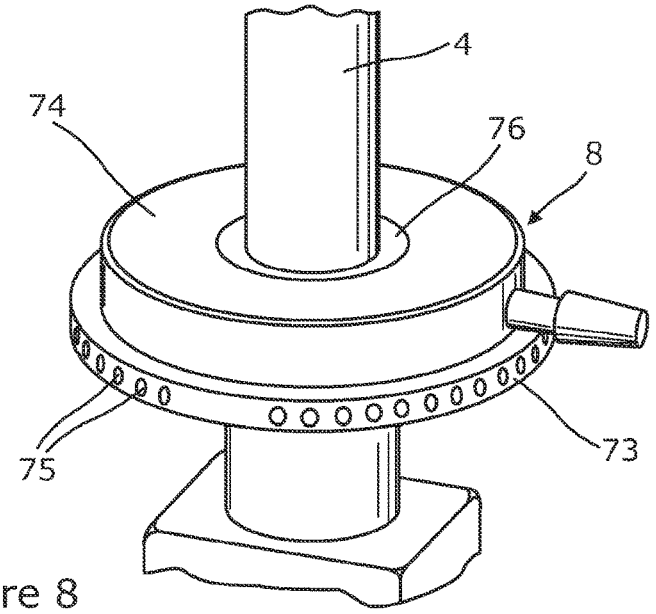
FIG. 8 shows a close up view of the moveable portion and pole.

The mechanisms described above can be applied in any combination to achieve the desired movement. FIG. 8 shows the moving portion 8 and pole 4 with protruding section 14 from which the beam is emitted. In this embodiment the moving portion comprises two disks 73 and 74. Disk 73 includes LEDs 75 around its outer edge which in some embodiments may flash on and off to show the position of the beam (lights will turn on an off as the beam passes). This portion can also comprise the display section itself and can be configured to show red, amber and green lights for each player as described above, or the LEDs can represent remaining lives or hits. The lower disk 73 does not rotate but is carried up and down the pole by one of the mechanisms described above. The central portion 76 of the upper disk is fixed to the lower disk but the outer portion is free to rotate and bearings between the rotating and non-rotating portions allow for a smooth motion. A mechanism (such as any of those described above) within the structure causes the upper disk 74 to rotate. Protruding section 14 from which the beam emanates thus also rotates.

In general, circuitry and mechanisms for rotating and raising or lowering parts of the structure are hidden within the base, central pole and display or rotatable portions inside plastic casings to improve the appearance of the apparatus and to protect delicate components from damage.

A docking station for a personal music player can be added to the top of the apparatus (for example at the top of the central pole or on a disc or platform mounted at the top of the central pole). This way music can be played during the game. This feature would be particularly suited for use in a gym where the apparatus is being used to provide an interactive exercise device for customers. In an embodiment the apparatus can be configured to react to the music, for example the movement of the beam may slow down or speed up in order to ensure that jumps coincide with musical beats.

Figure 16:
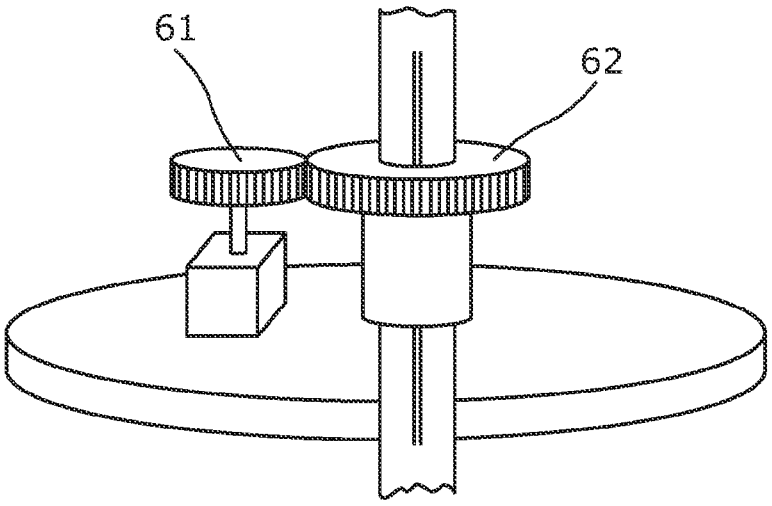
FIG. 16 shows another alternative mechanism for causing the rotating portion to rotate.
Figure 17A:
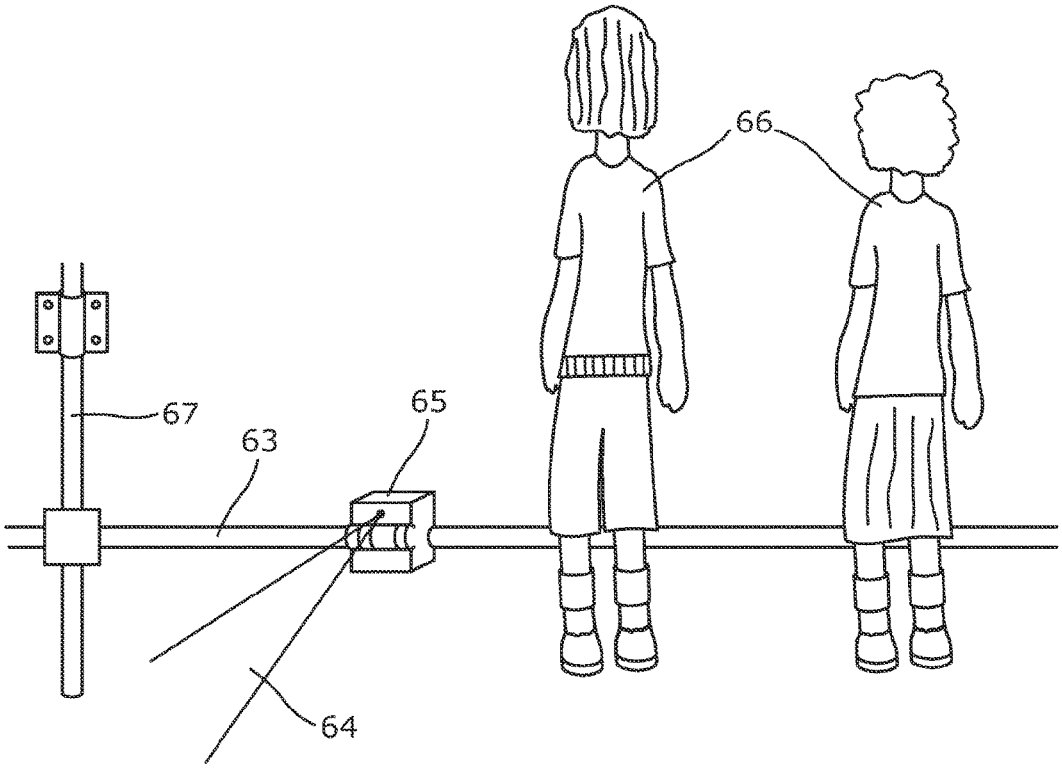
FIGS. 17A and 17B show an alternative embodiment of the present invention wherein the moveable portion is mounted on a rail; and, FIG. 18 shows a schematic of a circuit diagram for embodiments of the present invention.

FIG. 17A shows an alternative embodiment wherein the moving beam (which has similar features to the rotating beam/beams described above), rather than being mounted on a rotatable portion, is coupled to a horizontal rail 63 mounted on a wall. The beam 64 is emitted by slider 65 (or a protruding portion mounted on the slider) so that as the slider moves back and forth along the rail the beam also moves. Players 66 stand facing the wall and attempt to jump the beam as it passes. The rail can be fixed directly to the wall or can be arranged so that an end or both ends are coupled to a mechanism that allows it to be moved up and down. Any of the mechanisms illustrated in FIGS. 9 to 12 would be suitable to achieve this purpose if coupled to one or both ends of the rail. Alternatively each end of rail 63 can be coupled to a vertically orientated rail (67 in FIG. 16) along which it can slide to move up and down. The rail 63 can be moved vertically before starting the game (with or without the use of motors) and the slider and rail clamped at a desired height. Alternatively the rail 63 can be programmed to move up and down as the game is played (for example to increase difficulty from one level to the next or during a level). A wavy rail will also cause the slider to move up and down. If a wavy rail is used the movement of the slider will be more predictable as the shape of the rail is visible. The speed at which the slider moves back and forth along the rail 63 can also change throughout a game or can be pre-selected.

Figure 17B:
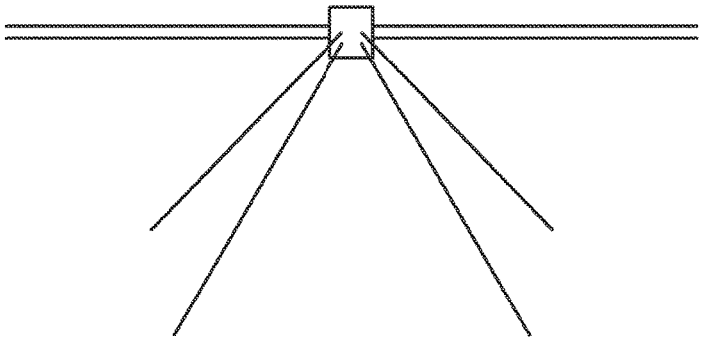

Several rails can be mounted together at different heights and each rail can have one or more sliders attached for emitting the beams of radiation. The game can be configured so that when a player manages to avoid a beam emitted by sliders on a higher rail fewer lives are lost (or more points gained) than would be lost if the player failed to clear a beam lower down. The rails need not be fixed to a wall and can be free-standing, collapsible or mounted on a wheeled structure for ease of use within a home or gym. Counters can be coupled to the devices worn by each player so that players need not necessarily be confined to their own territories. In this example, just as above where more than one beam is used at different radial positions on the rotatable portion, a plurality of beams can be provided by the moveable portion on the rail. In other words the moveable portion could emit two beams in a V-like configuration such that as it slides on the rail a user would have to jump twice to avoid each of the arms of the V. This is shown schematically in FIG. 17B.

Figure 18:
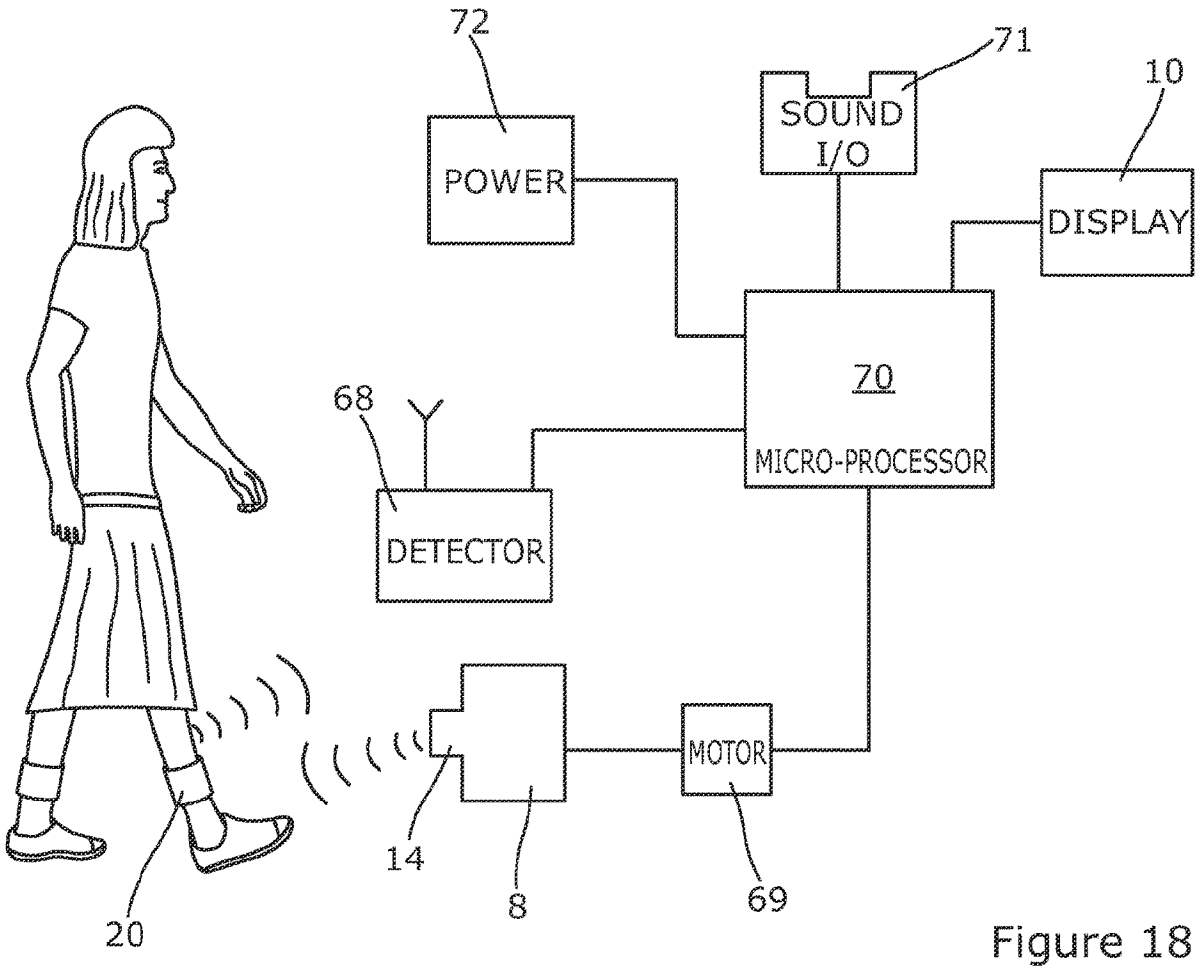

FIG. 18 represents a circuit diagram corresponding to the apparatus described above. The beam of radiation is emitted from moveable portion 8 through protruding part 14 and is reflected by the reflective ankle band to detector 68. Motor or motors 69 control the rotational, back and forth and the upwards and downwards motion of the moveable portion 8. A microprocessor 70 (comprising hardware such as one or more integrated circuits) controls the system and receives and responds to input from the detector or from a user desiring to change settings on the apparatus. The counters for recording the number of hits during a game for the players are coupled to the microprocessor which also controls the action of parts of the apparatus and how this should change with time or in response to external input. Display portion 10 is connected to the microprocessor for enabling users to visualise the progress of the game and can include sound output (speakers) and movement as well as the basic screen. Sound input/output block 71 allows the user to dock an ipod or another device on the apparatus. Aside from just playing music on the laptop the apparatus can respond (via microprocessor 70), for example by altering the action of motors 69 or display portion 10. Power is provided at power input 72 which may be a connection to the mains or battery (rechargeable or not) among others.

Embodiments of the present invention have been described with particular reference to the examples illustrated. However, it will be appreciated that variations and modifications may be made to the examples described within the scope of the present invention.

The invention claimed is:

1. An apparatus for playing a game, the apparatus comprising;

a moveable portion configured to emit a moving beam of radiation, a detector and a device arranged to be worn by a player, wherein the device is configured to send a signal to the detector in response to interaction with the moving beam, wherein the beam of radiation has a vertical beam angle of between 10 and 60 degrees.

2. The apparatus of claim 1, the apparatus further comprising at least one counter.

3. The apparatus of claim 2, wherein each of the one or more counters corresponds to a portion of the area swept out by the beam of radiation, wherein each of the one or more counters is configured to increment by one if the detector detects a signal when the beam is located in the portion of the area corresponding to that counter.

4. The apparatus of claim 1, wherein the device arranged to be worn by a player has a reflective outer layer.

5. The apparatus of claim 1, wherein the device arranged to be worn by a user is worn around the ankle.

6. The apparatus of claim 1, wherein the moveable portion is configured to be moveable in the upwards and downwards direction.

7. The apparatus of claim 1, wherein the moveable portion is configured to slide along a horizontal rail.

8. The apparatus of claim 1, wherein the moveable portion is a rotatable portion.

9. The apparatus of claim 1, wherein the detector is attached to the moveable portion adjacent to the emitting portion.

10. The apparatus of claim 3, wherein the apparatus further comprises a display section.

11. The apparatus of claim 10, wherein when one of the at least one counters increments by one, the display section is configured to change to reflect this increment.

12. The apparatus of claim 1, the apparatus further comprising a stationary base section.

13. The apparatus of claim 6, wherein the moveable portion is configured to move upwards and downwards using one or more of a rack and pinion mechanism, electrically powered rotors, and a lifting jack mechanism.

14. The apparatus of claim 6, wherein the moveable portion is configured to move upwards and downwards using a belt and gear mechanism.

15. The apparatus of claim 8, wherein the rotatable portion is configured to rotate and to move upwards and downwards using a tilting wheel and motor mechanism.

16. The apparatus of claim 8, wherein the rotatable portion is configured to rotate using a toothed belt and motor.

17. The apparatus of claim 8, wherein the rotatable portion is configured to rotate using gears and a motor.

18. The apparatus of claim 8, wherein the rotatable portion is configured to rotate using a motor, disc and wheel.

19. The apparatus of claim 8, wherein the rotatable portion is arranged to rotate through a full 360 degrees and/or can rotate in either direction.

20. An apparatus for playing a game, the apparatus comprising;

a moveable portion configured to emit a moving beam of radiation, a detector and a device arranged to be worn by a player, wherein the device is configured to send a signal to the detector in response to interaction with the moving beam, wherein the wherein the moveable portion is configured to be moveable in the upwards and downwards direction and the moveable portion is configured to move upwards and downwards using one or more of a rack and pinion mechanism, one or more electrically powered rotors, and a lifting jack mechanism.

* * * * *